US010844818B2

(12) United States Patent
Pasquali et al.

(10) Patent No.: US 10,844,818 B2
(45) Date of Patent: Nov. 24, 2020

(54) HOLDING COMPONENT AND FUEL INJECTION ASSEMBLY FOR AN INTERNAL COMBUSTION ENGINE

(71) Applicant: CPT GROUP GMBH, Hannover (DE)

(72) Inventors: Marco Pasquali, Leghorn (IT); Andrea Puccini, San Miniato (IT)

(73) Assignee: VITESCO TECHNOLOGIES GMBH, Hanover (DE)

( * ) Notice: Subject to any disclaimer, the term of this patent is extended or adjusted under 35 U.S.C. 154(b) by 0 days.

(21) Appl. No.: 16/323,020

(22) PCT Filed: Jul. 31, 2017

(86) PCT No.: PCT/EP2017/069303

§ 371 (c)(1),
(2) Date: Feb. 4, 2019

(87) PCT Pub. No.: WO2018/024668

PCT Pub. Date: Feb. 8, 2018

(65) Prior Publication Data

US 2019/0170101 A1 Jun. 6, 2019

(30) Foreign Application Priority Data

Aug. 4, 2016 (EP) ..... 16182702

(51) Int. Cl.
*F02M 61/14* (2006.01)
*F02M 61/16* (2006.01)

(52) U.S. Cl.
CPC ..... *F02M 61/14* (2013.01); *F02M 61/168* (2013.01); *F02M 2200/852* (2013.01); *F02M 2200/853* (2013.01)

(58) Field of Classification Search
CPC ..... F02M 61/14; F02M 61/168; F02M 2200/852; F02M 2200/853
(Continued)

(56) References Cited

U.S. PATENT DOCUMENTS 5,803,052 A * 9/1998 Lorraine ..... F02M 61/145 123/456
5,970,953 A * 10/1999 Lorraine ..... F02M 61/14 123/470

(Continued)

FOREIGN PATENT DOCUMENTS

JP 2014092099 A 5/2014
WO 2015/135732 A1 9/2015 ..... F02M 51/00
WO 2018/024668 A1 2/2018 ..... F02M 61/14

OTHER PUBLICATIONS

Extended European Search Report, Application No. 16182702.7, 6 pages, dated Jan. 20, 2017.

(Continued)

*Primary Examiner* — Joseph J Dallo
*Assistant Examiner* — Yi-Kai Wang
(74) *Attorney, Agent, or Firm* — Slayden Grubert Beard PLLC

(57) ABSTRACT

Various embodiments include a holding component for securing a fuel injector to an injector cup comprising: a U-shaped holding element with two parallel supporting arms for engaging opposite sides of an annular groove in the fuel injector to secure the fuel injector in the injector cup; a base part; two resilient arms extending from the base part for engaging the outer surface of the injector cup; and a depending leg engageable in a corresponding receiving part on the fuel injector to accurately position the fuel injector angularly relative to the injector cup.

11 Claims, 2 Drawing Sheets

(58) Field of Classification Search
USPC ..... 123/470
See application file for complete search history.

(56) References Cited

U.S. PATENT DOCUMENTS

| | | | | |
|---|---|---|---|---|
| 7,063,075 | B2 * | 6/2006 | Berger | F02M 61/14 123/456 |
| 7,802,559 | B2 * | 9/2010 | Furst | F02M 61/14 123/470 |
| 8,408,184 | B2 * | 4/2013 | Marc | F02M 61/14 123/470 |
| 8,479,710 | B2 | 7/2013 | Davis | 123/470 |
| 9,506,438 | B2 * | 11/2016 | Inomata | F02M 61/12 |
| 9,938,948 | B2 * | 4/2018 | Serra | F02M 61/145 |
| 2010/0300406 | A1 | 12/2010 | Harvey et al. | 123/456 |
| 2013/0192565 | A1 * | 8/2013 | Roseborsky | F02M 61/14 123/470 |
| 2015/0330347 | A1 | 11/2015 | Pohlmann et al. | 239/408 |
| 2017/0356413 | A1 * | 12/2017 | Oh | F02M 61/14 |
| 2018/0372045 | A1 * | 12/2018 | Oh | F02M 61/168 |

OTHER PUBLICATIONS

International Search Report and Written Opinion, Application No. PCT/EP2017/069303, 10 pages, dated Sep. 12, 2017.
Korean Notice of Allowance, Application No. 2020050618244, 3 pages.

* cited by examiner

HOLDING COMPONENT AND FUEL INJECTION ASSEMBLY FOR AN INTERNAL COMBUSTION ENGINE

CROSS-REFERENCE TO RELATED APPLICATIONS

This application is a U.S. National Stage Application of International Application No. PCT/EP2017/069303 filed Jul. 31, 2017, which designates the United States of America, and claims priority to EP Application No. 16182702.7 filed Aug. 4, 2016, the contents of which are hereby incorporated by reference in their entirety.

TECHNICAL FIELD

The present disclosure relates to internal combustion engines. Various embodiments may include a holding component for securing a fuel injector to an injector cup, a fuel injection assembly for an internal combustion engine, and/or a gasoline direct injection internal combustion engine comprising the holding component.

BACKGROUND

Fuel injection assemblies are widely used for injecting fuel into an internal combustion engine, particularly having an injector for each cylinder of a multi-cylinder engine in which the fuel is supplied from a reservoir in the form of a common rail to which each of the injectors is connected. The assembly is also suitable for use in a single cylinder engine. In known systems the injectors are secured directly to the cylinder head of the engine to project into the combustion chamber. Such arrangements transmit noise generated by the injection and combustion process through the engine to the exterior. In order to reduce noise transmission one known solution is to isolate the injector from direct mechanical connection with the engine. One solution to this problem is to suspend the injector in a fuel rail injector cup by means of a holding element, commonly called a fork clip. The injector cup itself is secured to the fuel rail and the engine. In this way there is no direct mechanical coupling between the injector and the engine components.

It is possible for the fuel injector to pivot about the axis of the injector cup during assembly. It is necessary, however, for the angular position of the fuel injector to be precisely positioned relative to the injector cup so that the fuel injector fuel output is in the correct position for fuel injection into the combustion chamber. In the known arrangements this is achieved by means of a further component known as an indexing clip. Such arrangements are shown for example in U.S. Pat. No. 8,479,710 and WO 2015/135732.

U.S. 2015/330347 A1 discloses a system, which is used especially as a fuel injection system for the high-pressure injection in internal combustion engines. It includes a fuel distributor and a plurality of fuel injectors. Each fuel injector is situated on a cup of the fuel distributor. At least one of the fuel injectors is fastened to the associated cup by a holding element. The holding element has an at least essentially straight first leg and an at least essentially straight second leg. The cup includes at least one recess, which extends through a wall of the cup. The first leg and the second leg are guided through the at least one recess. Furthermore, the connection sleeve of the fuel injector has a collar, which is braced on the first leg of the holding element and on the second leg of the holding element in order to secure the fuel injector on the cup. This makes it possible to fasten the fuel injector on the cup in a reliable manner.

SUMMARY

The teachings of the present disclosure describe an improved holding component and a fuel injection assembly which has less components than the known arrangement, in which the holding element and the indexing clip are combined into one component. For example, some embodiments include a holding component (14) for securing a fuel injector (4) to an injector cup (2), comprising a generally U-shaped holding element having two generally parallel supporting arms (18) for engaging opposite sides of an annular groove (11) in the fuel injector to secure the fuel injector (4) in the injector cup (2), wherein the holding component (14) further includes two resilient arms (28) extending from a base part (16) of the holding component (14) for engaging the outer surface of the injector cup (2) and at least one depending leg (22) engageable in a corresponding receiving part on the fuel injector (4) to accurately position the fuel injector (4) angularly relative to the injector cup (2).

In some embodiments, the holding component (14) is formed of a moulded plastics material.

In some embodiments, the holding element is a one-piece component formed from a sheet metal material.

In some embodiments, the two parallel supporting arms (18) of the holding element comprise a double thickness of material, the two resilient arms (28) being formed of a single thickness of material.

In some embodiments, the holding component (14) has two depending legs (22) in spaced parallel relationship, each leg (22) being engageable in a corresponding receiving part on the fuel injector.

In some embodiments, the roots of the resilient arms extend from a resilient web part (24) of the base part (16) which enable the resilient arms (28) to move in the direction of their longitudinal extent.

In some embodiments, at their free ends, the two resilient arms (28) have inwardly extending projections (32) which, when the holding component (14) is inserted in the injector cup (2), engage the injector cup (2) to lock the holding component (14) in position.

As another example, some embodiments include a fuel injection assembly having a longitudinal axis L and comprising a holding component (14) according to any one of the preceding claims, the fuel injector (4) and the injector cup (2), wherein: the fuel injector (4) is an elongate fuel injector (4) having a fuel inlet port and a fuel outlet port, the injector cup (2) comprises a generally cylindrical body extending along the axis L and having an upper and a lower end, the cup (2) has a recess at its lower end in which the fuel inlet port (10) of the fuel injector (4) is received, a first opening or openings (12) is/are formed in the peripheral wall of the injector cup (2) in which the holding element (16, 18) of the holding component (14) is received, the supporting arms (18) engage opposite sides of an annular groove (11) in the fuel injector (4) to secure the fuel injector in the injector cup (2), the resilient arms (28) engage the outer surface of the injector cup (2) and the at least one depending leg (22) engages in the corresponding receiving part on the fuel injector (4) to accurately position the fuel injector (4) angularly relative to the injector cup (2).

In some embodiments, the holding component (14) has two depending legs (22) in spaced parallel relationship, each leg being engaged in a corresponding receiving part on the fuel injector (4).

In some embodiments, the receiving parts comprise recesses in the fuel injector.

In some embodiments, at their free ends, the two resilient arms (28) have inwardly extending projections (32) which engage the injector cup (2) to lock the holding component (14) in position.

In some embodiments, the recesses are formed in a plastics component part of the fuel injector.

BRIEF DESCRIPTION OF THE DRAWINGS

An example embodiment of the teachings of the present disclosure is described by way of example with reference to the accompanying drawings, in which.

Figure 2:
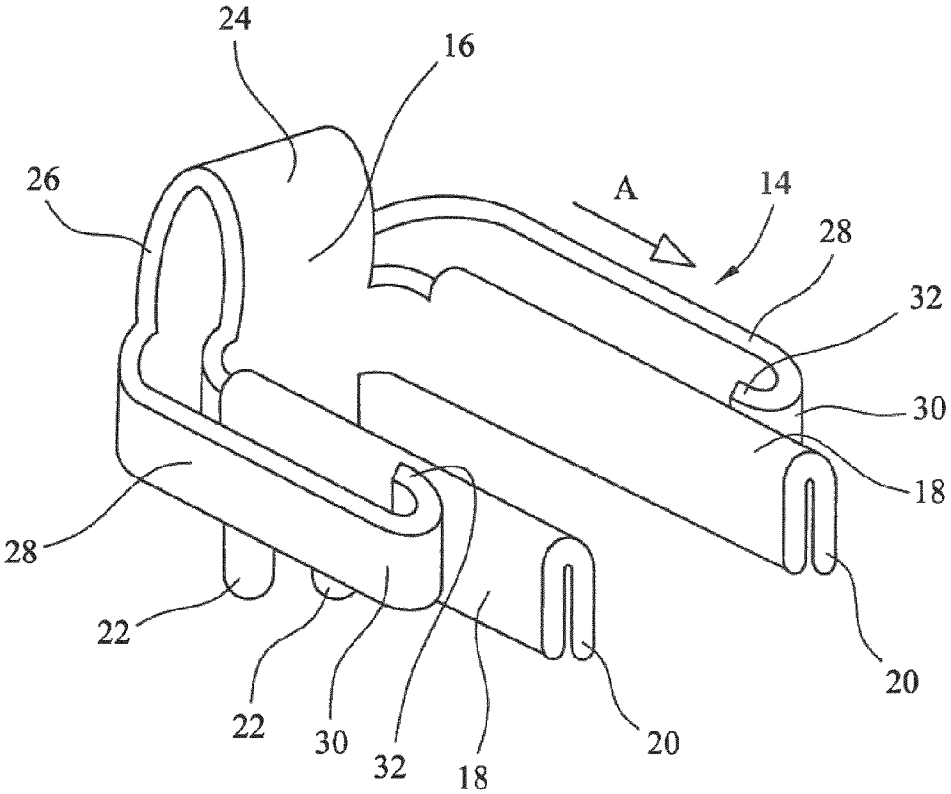
FIG. 2 shows a holding component for securing the fuel injector to the injector cup, incorporating the teachings of the present disclosure.

In this description reference is made to upper and lower ends but this nomenclature is used solely for descriptive convenience. In the installed condition, the orientation of the assembly depends upon the particular configuration.

DETAILED DESCRIPTION

The present disclosure describes a holding component for securing a fuel injector to an injector cup. Various embodiments comprise a generally U-shaped holding element having two generally parallel supporting arms for engaging opposite sides of an annular groove in a fuel injector to secure the fuel injector in an injector cup. To put it differently, the two generally parallel supporting arms are shaped and arranged to engage opposite sides of an annular groove in a fuel injector to secure the fuel injector in an injector cup.

In some embodiments, the holding component further includes two resilient arms extending from a base part of the holding component for engaging the outer surface of the injector cup. In other words, the two resilient arms are adapted to engage the outer surface of the injector cup.

In some embodiments, the holding element also has at least one depending leg engageable in a corresponding receiving part on the fuel injector to accurately position the fuel injector angularly relative to the injector cup.

In some embodiments, a fuel injection assembly includes a longitudinal axis and comprises an elongate fuel injector having a fuel inlet port and a fuel outlet port, an injector cup, and a holding component for securing the fuel injector in the injector cup. The injector cup comprises a generally cylindrical body extending along the axis and having an upper and a lower end. The cup has a recess at its lower end adapted to receive a fuel inlet port of the fuel injector. In particular, the fuel inlet port is received in the recess.

A first opening is formed or first openings are formed in the peripheral wall of the injector cup for receiving a holding element of the holding component. In particular, the holding element is received in the first opening(s). In some embodiments, the holding element is generally U-shaped having two generally parallel supporting arms engaging opposite sides of an annular groove in the fuel injector to secure the fuel injector in the injector cup. In some embodiments, the holding component further includes two resilient arms extending from a base part of the holding component and engaging the outer surface of the injector cup and at least one depending leg engaged in a corresponding receiving part on the fuel injector to accurately position the fuel injector angularly relative to the injector cup.

Embodiments incorporating teachings of this disclosure may have the advantage of a low-cost solution to the known problems both because of the reduction in the number of individual components, the lower cost of production of the component, and the speeding up of assembly. Assembly of the fuel injector and injector cup is a simple two stage operation; the injector is inserted in the injector cup, the holding component is pushed into place to locate the injector in the injector cup and then the depending leg is clipped into place to give accurate rotary alignment of the injector and the injector cup.

In some embodiments, the two parallel supporting arms of the holding element comprise a double thickness of material, the two resilient arms being formed of a single thickness of material.

In some embodiments, the roots of the resilient arms extend from a resilient web part of the base part which enable the resilient arms to move in the direction of their longitudinal extent.

In some embodiments, the two resilient arms have inwardly extending projections at their free ends which, when the holding component is inserted in the injector cup, engage the injector cup to lock the holding component in position.

In some embodiments, the holding element is a one-piece component formed from a sheet metal material. In some embodiments, the holding component is formed of a moulded plastics material. When formed of a sheet material, the two parallel supporting arms of the holding element comprise a double thickness of material, the two resilient arms being formed of a single thickness of material. For example, the double thickness of material may be achieved by folding the material over on itself.

In some embodiments, the holding component has two depending legs in spaced parallel relationship, each leg being engageable in a corresponding receiving part on the fuel injector. In an assembled state of the fuel injector assembly, each leg may expediently engage the corresponding receiving part on the fuel injector. In some embodiments, the receiving parts comprise recesses in the fuel injector. In some embodiments, the recesses are formed in a plastics component part of the fuel injector. In this way, the recesses can be preformed in a mold from which the plastics component is manufactured.

Figure 1:
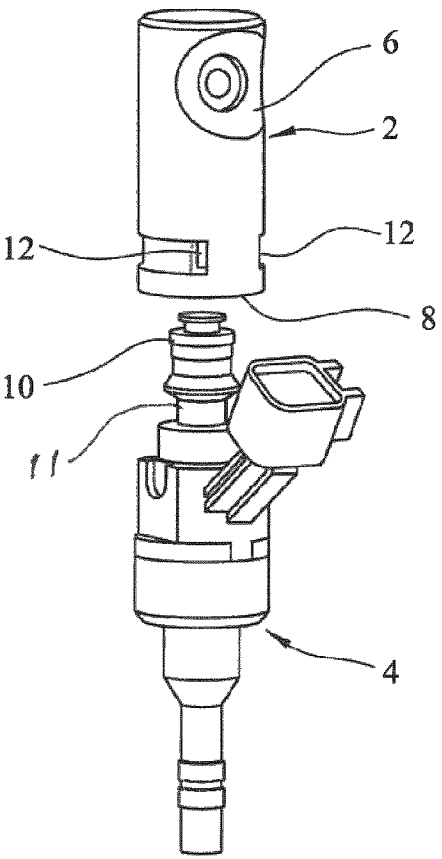
FIG. 1 shows an example fuel injector assembly of an injector cup and a fuel injector, incorporating the teachings of the present disclosure.

FIG. 1 shows an example fuel injector cup 2 for receiving a fuel injector 4, the cup comprising a generally cylindrical body. The cup 2 is fastened to a tubular fuel rail (not shown) in a mechanically secure and hydraulically fluid tight manner. For example, the cup 2 may have and one or more openings adjacent its upper end through which the cup 2 is fastened to the fuel rail. In the illustrated embodiment, the cup 2 has an arcuate cutaway 6 through which the cup 2 is fastened to the fuel rail. At its lower end the cup 2 has an opening 8 for receiving the fuel inlet 10 of the fuel injector 2. The fuel injector inlet 10 engages with the hydraulic connection to the fuel rail to provide a direct fuel path between the common rail reservoir and the fuel injector 4. The fuel injector has an annular groove 11 which is engageable by a holding component 14, described hereinafter, which locates the fuel injector securely in the injector cup 2.

FIG. 2 shows a holding component 14 formed by shaping from a resilient sheet metal material. The component 14 has a base part 16 from which two supporting arms 18 extend in spaced generally parallel relationship. The arms 18 are formed of a double thickness material by folding the material over on itself as can be seen from the free ends 20. The base part 16 also has depending therefrom two legs 22 which are adapted to engage in corresponding recesses in a part of the fuel injector 4 when the holding component secures the fuel injector 4 to the injector cup 2.

Extending from the base part 16 is a curved web 24, U-shaped in cross-section, and, from a part 26 of the web remote from the base part 16, two resilient arms 28 extend to lie generally on the outer side, but spaced from, the supporting arms 20. The resilient arms 28 lie on the outside of the injector cup 2 and are resiliently biased inwardly so as to contact the exterior of the injector cup 2. At their outer free ends 30, the resilient arms 28 have inwardly projecting latches 32 which, when the holding component 14 is inserted in the injector cup 2, clip into corresponding recesses or detents in the injector cup surface to thereby lock the holding component 14 to the injector cup 2. Although shown in the schematic sketch of FIG. 2 as straight, it will be appreciated that the resilient arms 28 will be shaped to the general profile of the injector cup 2.

Figure 3:
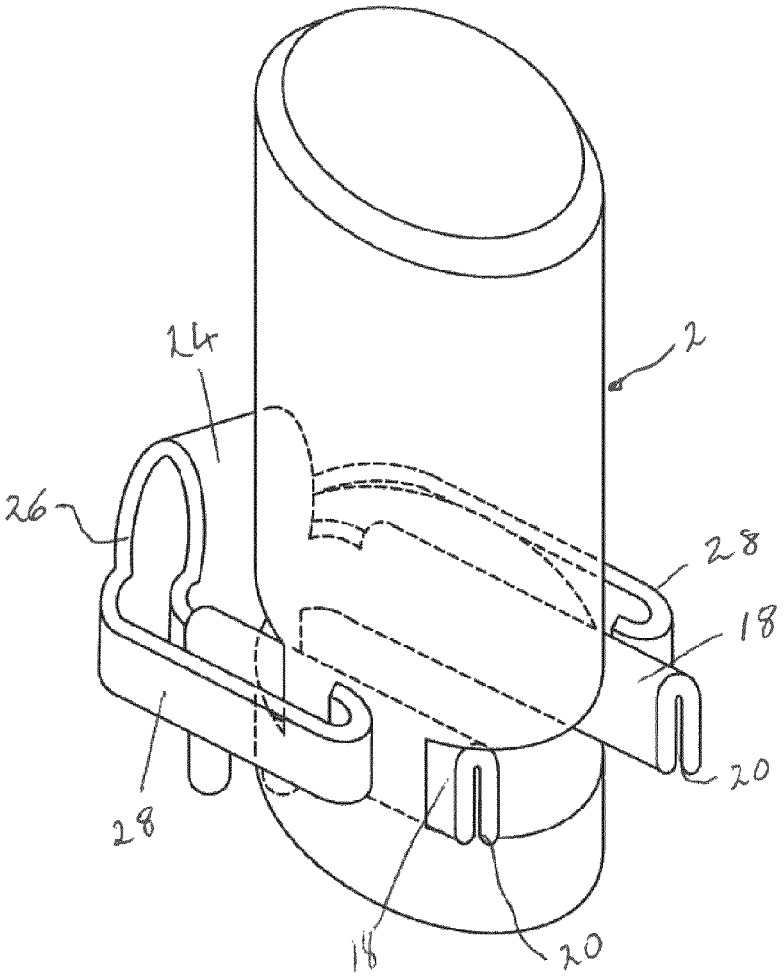
FIG. 3 shows a schematic view of the holding component positioned in the injector cup incorporating the teachings of the present disclosure.

FIG. 3 shows a schematic view of the holding component 14 inserted in the injector cup 2. In operation, when securing a fuel injector 4 in the injector cup 2, the inlet port 10 of the injector 4 is first inserted in the injector cup 2 and the supporting arms 18 of the holding component 14 are inserted through openings in opposed sides of the injector cup wall so that the supporting arms 18 support the fuel injector 4 by engaging on opposite sides of the groove 11 in the fuel injector 4.

Thereafter, the supporting arms 18 are fully inserted in the injector cup 2 until the base part 16 abuts the outer wall of the injector cup 2. Thereupon, the angular position of the fuel injector 4 is adjusted until the recesses therein are aligned with the two legs 22. Then, by pressing on the web part 26 against the resilient bias of the web 24, the resilient arms 28 are moved longitudinally in the direction of the arrow A until the latches 32 engage in detents or catches on the injector cup 2. In this way, the two legs 22 are firmly located in the recesses in the fuel injector 4 to fasten the fuel injector securely in the correct orientation.

The holding component 14 thus serves the function of the two or more components of the known prior art, namely the holding element and the indexing clip. The use of the single component therefore greatly reduces assembly time on the production line and eliminates a potential source of errors when two or more components have to be used. It also reduces the cost of inventory and logistics in transporting compared with using two or three separate components. Manufacturing the holding component from a single flat sheet of metal by simply folding and shaping the material into the component is particularly advantageous in providing a very cost-effective and speedy solution.

In some embodiments, the holding component may be formed of a molded plastics material.

What is claimed is:

1. A holding component for securing a fuel injector to an injector cup, the holding component comprising:

a U-shaped holding element with two parallel supporting arms for engaging opposite sides of an annular groove in the fuel injector to secure the fuel injector in the injector cup;

a base part extending along a longitudinal axis of the fuel injector, wherein the two parallel supporting arms extend from the base part at a first axial position;

two resilient arms extending from the base part at the first axial position for engaging an outer surface of the injector cup; and a depending leg extending from the base part along the longitudinal axis at a second axial position, the depending leg engageable with a recess in the fuel injector to accurately position the fuel injector angularly relative to the injector cup, and wherein the second axial position is more remote from the injector cup than the first axial position.

2. A holding component according to claim 1, wherein the holding component comprises a molded plastics material.

3. A holding component according to claim 1, wherein the holding element comprises a one-piece component formed from a sheet metal material.

4. A holding component according to claim 1, wherein the two parallel supporting arms comprise a double thickness of material and the two resilient arms comprise a single thickness of material.

5. A holding component according to claim 1, further comprising a second depending leg, wherein the two depending legs are in spaced parallel relationship, each leg engageable with a respective recess the fuel injector.

6. A holding component according to claim 1, wherein roots of the resilient arms extend from a resilient web of the base part enabling the resilient arms to move in a direction of their longitudinal extent.

7. A holding component according to claim 1, wherein at respective free ends, the two resilient arms have inwardly extending projections which, when the holding component is inserted in the injector cup, engage the injector cup to lock the holding component in position.

8. A fuel injection assembly having a longitudinal axis, the fuel injection assembly comprising:

an elongate fuel injector having a fuel inlet port, a fuel outlet port, and an annular groove;

an injector cup with a generally cylindrical body extending along the longitudinal axis with an upper end and a lower end and having an outer surface;

a holding component comprising:

a U-shaped holding element with two parallel supporting arms for engaging opposite sides of the annular groove to secure the fuel injector in the injector cup;

a base part extending along a longitudinal axis of the fuel injector, wherein the two parallel supporting arms extend from the base part at a first axial position;

two resilient arms extending from the base part at the first axial position for engaging the outer surface of the injector cup; and a depending leg extending from the base part along the longitudinal axis at a second axial position, the depending leg engageable with a first recess in the fuel injector to accurately position the fuel injector angularly relative to the injector cup, and wherein the second axial position is more remote from the injector cup than the first axial position;

wherein the injector cup has a second recess at the lower end receiving the fuel inlet port;

an opening formed in a peripheral wall of the injector cup receiving the holding element;

wherein the supporting arms engage opposite sides of the annular groove.

9. A fuel injector assembly according to claim 8, wherein the holding component further comprises a second depending leg and the two depending legs are in spaced parallel relationship, each leg engaged with a corresponding recess the fuel injector.

10. A fuel injector assembly according to claim 8, wherein at respective free ends, the two resilient arms have inwardly extending projections engaging the injector cup to lock the holding component in position.

11. A fuel injector assembly according to claim 8, wherein the first recess is formed in a plastics component part of the fuel injector.

* * * * *